US005904439A

United States Patent [19]

Devlin

[11] Patent Number: 5,904,439

[45] Date of Patent: May 18, 1999

[54] MOVEMENT JOINT

[76] Inventor: Seamus Michael Devlin, Stairs Hill Barn, Stairs Hill, Empshott Nr Selborne Hampshire, United Kingdom, GU33 6HZ

[21] Appl. No.: 08/817,476

[22] PCT Filed: Oct. 18, 1995

[86] PCT No.: PCT/GB95/02456

§ 371 Date: Jun. 3, 1997

§ 102(e) Date: Jun. 3, 1997

[87] PCT Pub. No.: WO96/12855

PCT Pub. Date: May 2, 1996

[30] Foreign Application Priority Data

Oct. 19, 1994 [GB] United Kingdom ..... 9421038

[51] Int. Cl.[6] ..... F16B 2/22

[52] U.S. Cl. ..... 403/291; 403/12; 52/396.03; 52/396.06; 52/396.07; 404/48; 404/67

[58] Field of Search ..... 403/11, 12, 28, 403/29, 220, 291, 297; 52/396.03, 396.06, 396.07, 396.04, 396.08; 404/47, 49, 48, 64, 67

[56] References Cited

U.S. PATENT DOCUMENTS

| | | | |
|---|---|---|---|
| 3,713,263 | 1/1973 | Mullen | 52/396.04 |
| 3,951,562 | 4/1976 | Fyfe | 52/396.03 X |
| 4,204,373 | 5/1980 | Davidson . | |
| 4,319,855 | 3/1982 | Huber et al. | 52/396.04 X |
| 4,388,016 | 6/1983 | Levey | 52/396.03 X |
| 4,625,485 | 12/1986 | Nicholas | 52/396.06 |
| 4,807,292 | 2/1989 | DeLuca | 404/47 X |
| 5,450,699 | 9/1995 | Lee | 404/48 X |
| 5,494,369 | 2/1996 | Stock | 403/219 X |

FOREIGN PATENT DOCUMENTS

| | | | |
|---|---|---|---|
| 39076 | 8/1973 | Australia | 52/396.06 |
| 1468498 | 2/1966 | France . | |
| 2144620 | 3/1973 | Germany . | |
| 2357318 | 5/1974 | Germany | 404/64 |
| 3821756 | 1/1990 | Germany . | |
| 4036338 | 6/1991 | Germany . | |
| 318387 | 12/1969 | Sweden | 404/64 |
| 1291248 | 10/1972 | United Kingdom . | |
| 2171428 | 8/1986 | United Kingdom . | |

*Primary Examiner*—Harry C. Kim
*Attorney, Agent, or Firm*—Ware, Fressola, Van Der Sluys & Adolphson LLP

[57] ABSTRACT

A field limitation joint has a core (101) of closed cell synthetic elastomer and aluminum L-section side members (102). The core is adhered to the side members by double sided adhesive strip (103) of the type having reinforcing filaments (104) running along the length of the strip. The core is pre-compressed and held in compression by tapes (105, 106). These are fabric reinforced and incorporate a central strip (107) of polymer film rendering them non-adhesive along their center. Also they have perforations (108, 109) along their length at the edge of the strip (107). The adhesive edges (110) of the tape (105) are adhered to the outside of upright limbs (111) of the side members and pass over the top of the side members. The perforations (108) run along the top edge of the side members. The other tape (106) extends between the other limbs (112) of the side members on their undersides, again with the non-adhesive strip preventing adhesion to the core (101). On installation onto adhesive to which tiles also are to be set, the tapes maintain the compression of the core. After laying of the tiles, the compression is released by ripping of the top tape along its perforations (108).

26 Claims, 7 Drawing Sheets

MOVEMENT JOINT

The present invention relates to a movement joint.

Structural movement between individual parts of a building can and often does occur particularly in large buildings. The integrity of the building is seldom threatened, provided that it is adequately designed. However unsightly cracking in floors and walls in particular can be avoided by providing a "field limitation joint" in the finish layer of these surfaces. Generally such a joint includes a flexible member which is able to expand and compress with movement of the substrate layer(s) beneath the finish layer. The joint may induce controlled cracking of the substrata along its length, whereby the finish layer does not crack but can move as a block with respect to one or more adjacent blocks separated by the joint or several joints.

Similarly larger joints are also incorporated into large scale structures. These joints continue through structural floors and slabs, walls, ceilings and roofs and effectively divide the structure Into a series of separate buildings which are joined together by "structural movement joints". These large joints not only flex and move in response to drying shrinkage of the structure but also accommodate movement arising from thermal changes, wind loading, structural settlement and imposed loading within the structure.

The object of the present invention is to provide an improved movement joint, which is pre-compressed.

According to a first aspect of the invention there is provided a movement joint for installation between elements of a building, the joint being elongate and having a relatively flexible core member with relatively rigid side members to which the flexible member is bonded or otherwise affixed and which abut the building elements in use, the joint including means for restraining the flexible member to be under compression prior to installation between the building elements and for releasing the compression after installation.

Pre-compression of the joint allows for a greater degree of movement of the building elements on either side of the joint away from each other, before the core comes under tension and there is any tendency for the elements to separate from the joint.

Whilst it is envisaged that the restraining means may be an integral interconnection of the side members deformed to compress the flexible member, in one embodiment, the restraining means is in the form of U- or Y-section clips engaging by their limbs outside the side members. Generally the clips can be provided at substantial intervals along the length of the joint.

In another embodiment, alternative restraining means is provided in the form of at least one tape adhered to the side members. Preferably, the tape, is fibre reinforced tape. It can be perforated for tearing, preferably at edges of the side members, for release of the compression in the core member. Conveniently, the tape has a central, non-adhesive band for avoiding adhesion to the core member. One tape may be provided at a top of the joint (where the core is) and another tape is provided at the bottom of the joint. Particularly where the side members are integrally interconnected, a single tape only may be adequate to retain the compression of the core.

In the simplest form of the joint, the side members may be flat strips. In one preferred form, the side members are L-shaped, the upright limbs having the core between them and the other limbs extending away from each other and being adapted for fixture of the joint. This adaption may be merely adequate width for bonding of the joint to a substrate during installation, or may include additional features such as apertures for screw fixing. Screw fixing may be used for both field limitation joints and structural movement joints. Equally it is expected to be not normally necessary for either type of joint since the pre-compression in the joint allows appreciable separation of the building elements across the joint before it cones under tension.

In another form, the joint has a pointed cross-section, the side members converging towards each other at the bottom of the joint (away from the core). This form enables insertion of the joint into semi-dry floor substrate materials, In the pointed form of the joint, the side members can be integrally, connected to each other at the bottom of the joint. This connection contributes to the compression retention.

An extension may be provided beyond the bottom edge of the side members. The extension can be a single wall member integrally connected to the two side members. Alternatively, the extension can be of Y-cross-section engaged outside the side members by its upper limbs. In this alternative, the extension and the side members can be complementarily shaped for gripping of the side members by the extension. The extension can be adapted to contribute to compression retention of the core.

An unexpected advantage of the pre-compressing the joint is that soft core materials, that is which are soft in comparison with traditional joints' cores, can be used. These core materials allow a greater degree of compression than originally thought possible. The result is that the overall thickness of the joint—as installed—can be decreased. This is of particular advantage in that the installed width of the core, that is the pre-compressed width, can be less than the minimum recommended diameter of a stiletto heel. The British Shoe Federation recommend a minimum diameter of less than 5.5 mm. Indeed it is possible for the uncompressed width to be less than this diameter.

Not only is compressibility as such important in the choice of core materials, but compression set characteristics also are important. The order of width of crack expected to be accommodated by a movement joint is 1 mm. It is therefore preferred that a joint should be able to recover 1 mm after pre-compression. Surprisingly this can be achieved with a joint which as installed has a core width of a 2 mm only. This is achieved with a 4 mm uncompressed core of a material having a 50% compression set characteristic, namely the ability to expand to 3 mm on release from pre-compression to 2 mm. Such a joint, with side members each 1 mm thick, having an overall thickness of 4 mm is expected to replace conventional joints of 8 mm thickness, that is 1 mm side members and 6 mm core.

Closed cell synthetic elastomeric materials can exhibit suitable characteristics. Particularly suitable are those exhibiting a Shore hardness in the range 25° to 60°, preferably 30° to 45°. The preferred hardness is 35° to 40°.

The degree of pre-compression is suitably between 40% and 60%, preferably between 45% and 55%.

Locally, the side members can taper inwardly towards each other at their top; locally increasing the degree of pre-compression.

According to second aspect of the invention, there is provided a method of producing a movement joint wherein the side members are of metal or plastics material and the core is of synthetic elastomeric material, preferably closed cell foam material, the method consisting the steps of:

applying adhesive longitudinally to the core and/or the insides of the side members;

bonding the side members to the core;

compressing the core;

applying the restraining means to the joint to retain the core under compression prior to installation.

Preferably the adhesive is double sided tape adhesive with longitudinal reinforcement.

According to second aspect of the invention, there is provided a method of producing a movement joint wherein the side members and core are co-extrusions of plastics material side plates and synthetic elastomeric material core, preferably closed cell foam material, the method consisting the steps of:

co-extruding the side plates of plastic material and the core of synthetic elastomeric material;

compressing the core;

applying the restraining means to the joint to retain the core under compression prior to installation.

Where the restraining means is at last one tape adhered to the side members, the method preferably includes the step of:

passing the bonded side members and core between at least one pair of rollers for compressing the cores.

Preferably the core and the side members are flush at their top after bonding or co-extrusion and the method includes the step of:

trimming core material protruding above the side members preliminarily to applying the restraining tapes(s).

To help understanding of the invention, several specific embodiments thereof will now be described by way of example with reference to the accompanying drawings, in which.

Figure 1:
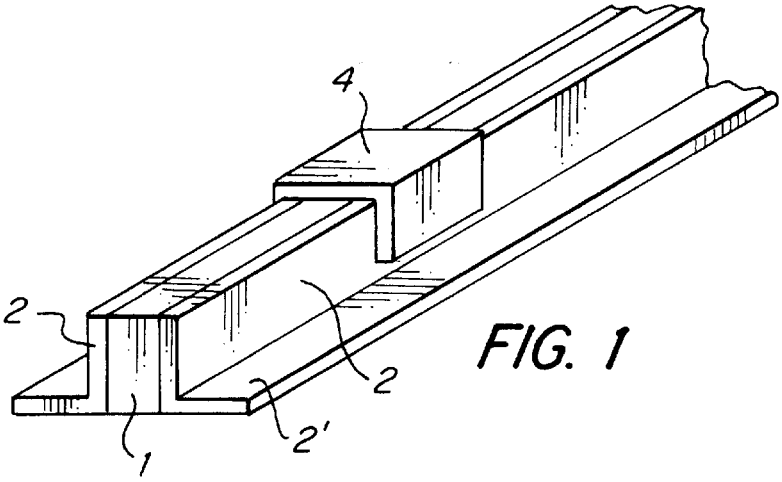
FIG. 1 is a perspective view of a length of a first field limitation joint according to the invention.
Figure 2:
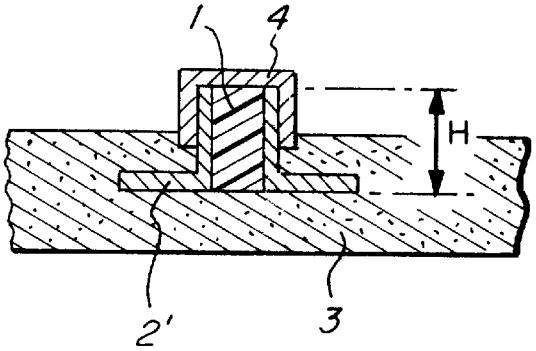
FIG. 2 is a cross-sectional end view of the joint of FIG. 1 after setting in a wet screed or adhesive.
Figure 3:
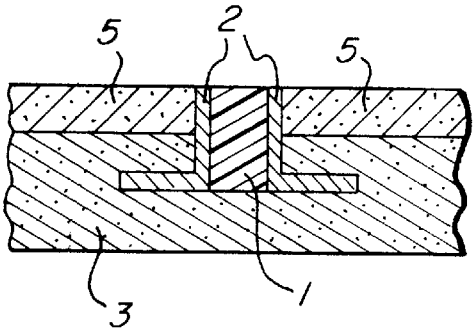
FIG. 3 is a similar view of the joint of FIG. 1 after a finishing layer has been laid to it.

Referring first to FIGS. 1, 2 and 3, the joint there shown is of a synthetic rubber flexible member 1 bonded or possibly vulcanized to brass side members 2 having an L-shaped cross-section. Prior to setting in an adhesive bed or a "wet" screed floor substrate 3, the flexible member is kept under compression by metal clips 4, conveniently of the same material as the side plates, e.g. brass, which are regularly spaced along the length of the joint. The clips are of invert U-shape and extend over at least 50% of the height H of the side members 2, in order to control the flexible member to be evenly compressed.

After setting of the joint in the substrate 3 and initial curing of the latter, the screed holds the flexible member 1 in compression by gripping of the horizontal webs 2' of the side members, The clips 4 can therefore be removed at this stage. Alternatively, the clips can be removed after laying of the finish layer 5. Again, where the finish layer is of the terrazzo type, which is cut and polished for finishing, the clips can be left in place and ground off.

The joint can be of conventional size that is of a thickness in the range 6 to 100 mm, or thinner e.g. 4 mm, and height in the range 6 to 250 mm. The clips can be at 250 mm centres. The flexible member can be of approximately 40° Shore hardness, held at 50% pre-compression.

The brass material of side members may be replaced by other metals or rigid plastics material. The clips similarly may be of other metals or materials. Other conventional means may be used for affixing the flexible member to the rigid side members.

Figure 4:
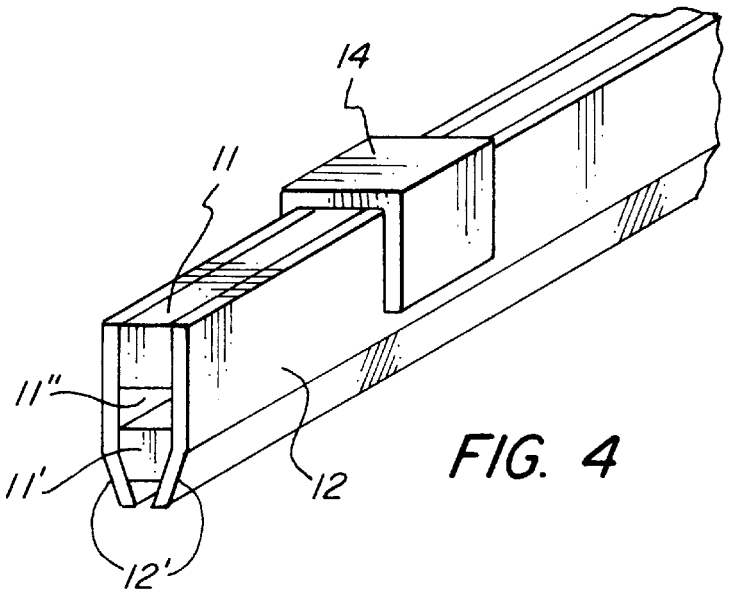
FIG. 4 is a view similar to FIG. 1 of another field limitation joint according to the invention.
Figure 5:
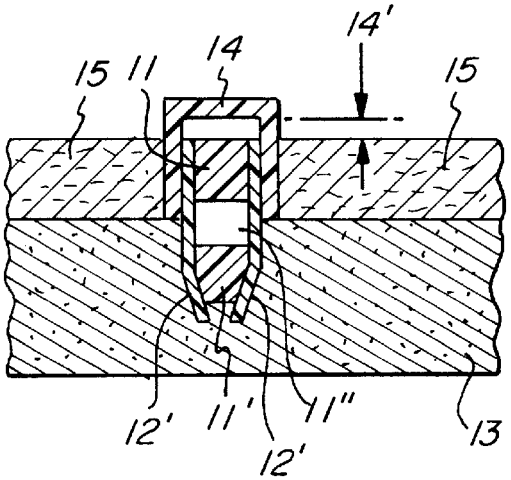
FIG. 5 is a cross-sectional end view of the joint of FIG. 4 after setting in semi-dry screed with tiles laid to the joint.
Figure 6:
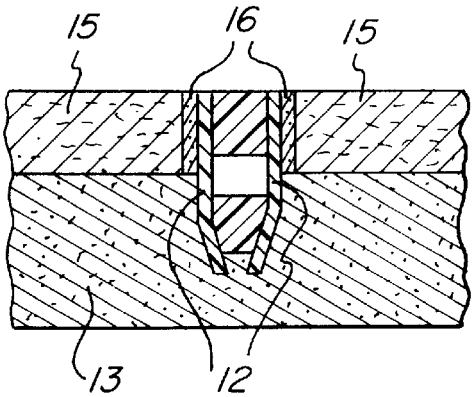
FIG. 6 is a similar view of the joint after grouting.
Figure 7:
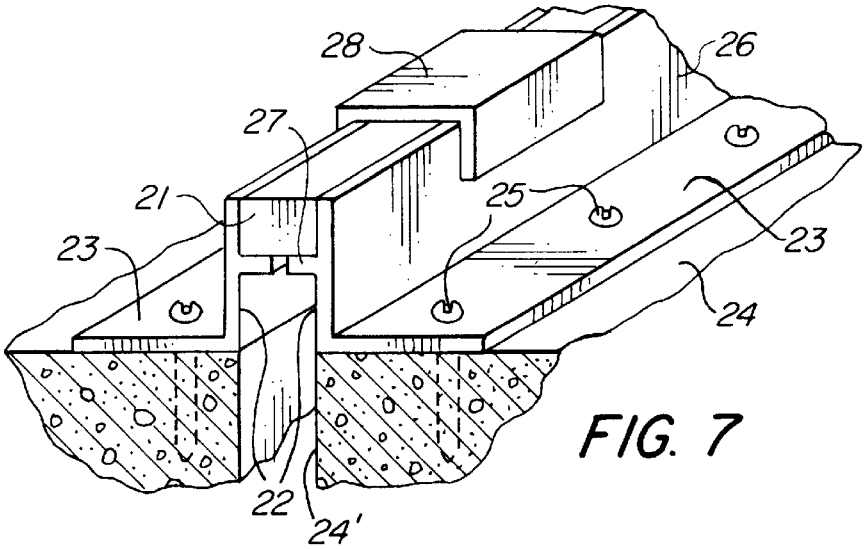
FIG. 7 is a perspective view of a length of a structural movement joint according to the invention.
Figure 8:
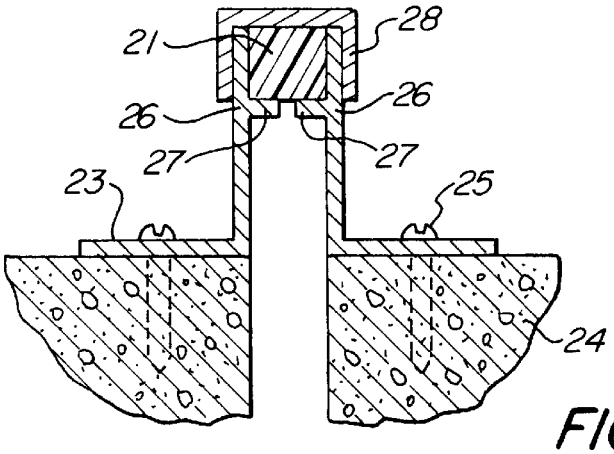
FIG. 8 is a cross-sectional end view of the joint of FIG. 7 after anchoring to a concrete base.

Turning now to FIGS. 4, 5 and 6, the joint here shown is a co-extrusion of an elastomeric polymer flexible filler 11, 11' between two rigid PVC side members 12. Extruded plastics clips 14 are provided at periodic intervals along the length of the joint and hold the flexible member in compression. A void 11" is provided between upper and lower portions of the filler, the upper portion 11 being the operative portion which is visible and load bearing in use. The side members are turned in at 12' to give the bottom portion of the joint a wedge shape, whereby it can be tapped into a semi-dry screed 13. Tiles 15 are set in the screed at the same time. Once the screed has initially cured, the clips 14 are removed. To facilitate this, they are arranged with a small gap 14' at the top of the upper portion of the upper portion 11" of the flexible filler. After removal of the clips, the tiles can be grouted 16, in the usual way.

Again the side members of this joint can be of other materials, e.g. metal, as can the clips.

After installation of the above described joints, the screeds in which they are set and the concrete on which the screeds are laid can be expected to continue to cure and shrink over an period of months extending into years. This shrinking allows part of the pre-compression in the joints to be released. However, some pre-compression remains so that the side members remain in firm contact with the screed and finish layers abutting them. Thus deterioration by ingress of dirt and water for instance is inhibited.

Turning now to FIGS. 7 to 10, the joint there shown is a structural movement joint. As such it is designed to accommodate greater movement and come under tension. For this it can be mechanically anchored in use.

The joint has a synthetic flexible core member 21 bonded or otherwise affixed to metal or rigid plastics side members 22 of L-shaped cross-section. For the core member, ALCRYN material—a polymer material marketed by the Dupont company—is suitable since it has good recovery characteristics, namely a 97.5% compression set. Via foot flanges 23 of the side members, these are anchored to a concrete bass 24 by screws 25 or anchor bolts (not shown), with the flexible member aligned directly over a structural gap 24' in the building concerned. The flexible member is positioned at the top of the leg flanges 26 of the side members and is supported by in-turned lips 27 against being, in use, pushed down between the flanges. Prior to anchoring, regularly spaced metal clips 28 hold the flexible member in compression between the two side members.

Figure 9:
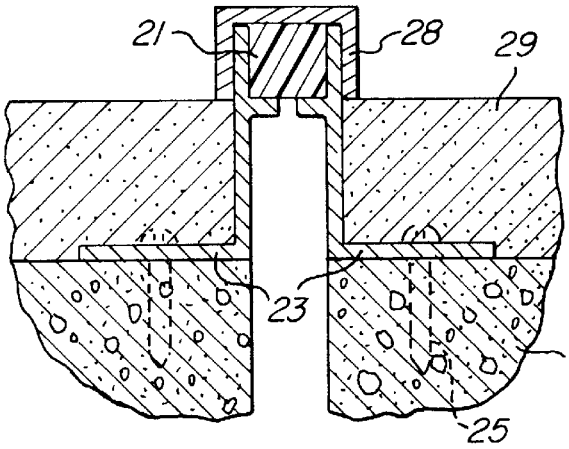
FIG. 9 is a similar view of the joint of FIG. 7 after screed has been laid along it.
Figure 10:
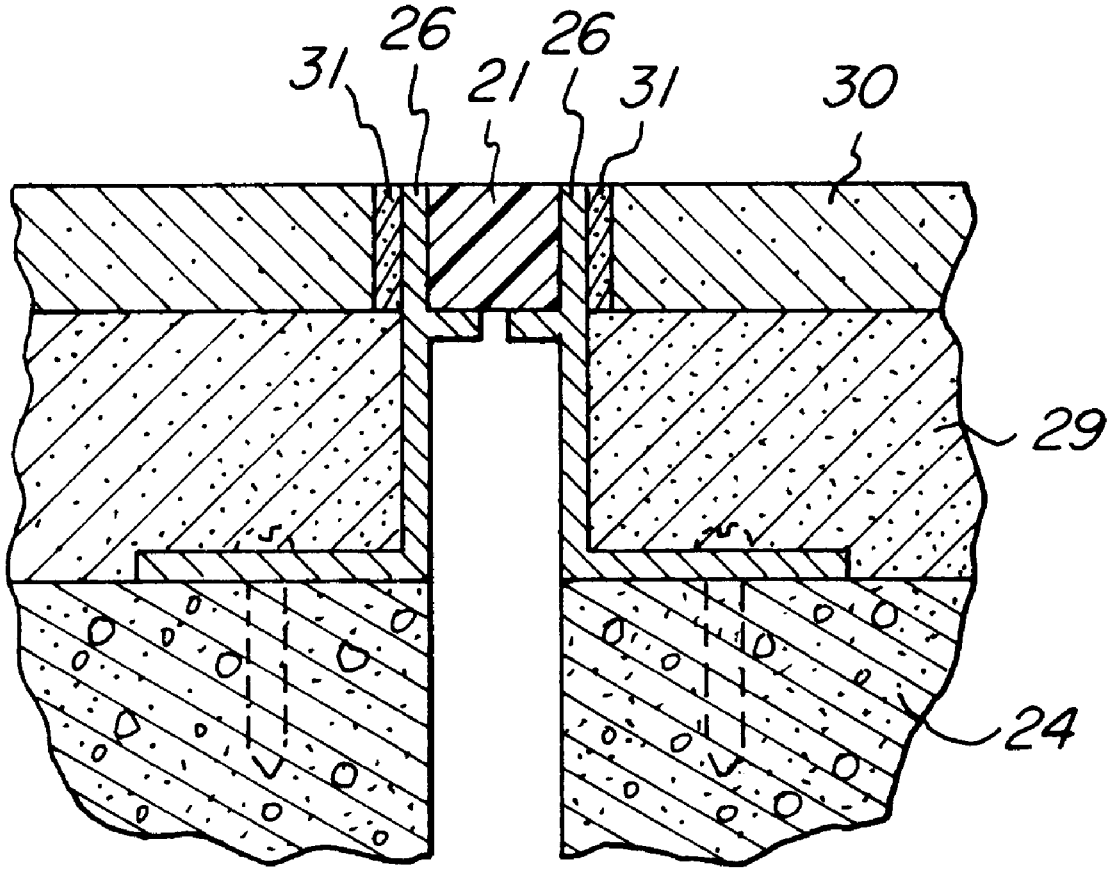
FIG. 10 is a further similar view of the joint of FIG. 7 after finish layers have been laid, the joint's retaining clip removed and the joint grouted.

Anchoring of the side members allows the clips to be removed with the flexible member being held in compression by the screws 25. Alternatively, as shown in FIG. 9, the clips can be retained in position until screed 29 has been laid. This covers the foot flanges 23 and the screws 25, assisting in anchoring the joint. The screed extends up to the level of the lips 27, i.e. the bottom of the flexible member 21. The clips many be removed after setting of the screed. Again it is possible to leave them in position until the finish layer 30 has been applied over the screed to the level of the top of the joint. Then the clips can be removed and the gaps left by them filled with grout 31.

In another alternative, the screws shown in FIGS. 7 to 10 can be dispensed with, where the setting of the joint is such as to ensure that the joint is secure when the pre-compression in it is released. This can be ensured by delaying release of the pre-compression until after the screed 29 has set, i.e. forty eight hours after it has been laid.

Providing the structural movement joint with compression in its flexible member reduces the occurrence of tension in the flexible member as the building elements move away from each other at the structural gap 24'. When the joint does come into tension, the degree of tension will be less. Thus there will be less tendency for spalling, that is failure of the concrete in tension along the line of the screws 25. Spelling results in complete failure of the joint, because it is then no longer anchored at least at one side. Further, reducing the tension on the flexible member reduces the loading on this, making it more durable.

Figure 11:
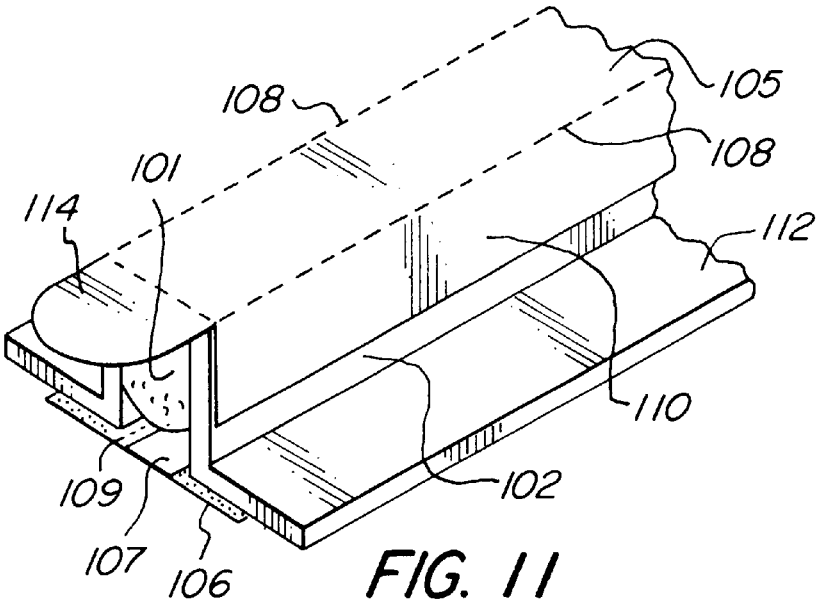
FIG. 11 is a view similar to FIG. 1 of another field limitation joint.
Figure 12:
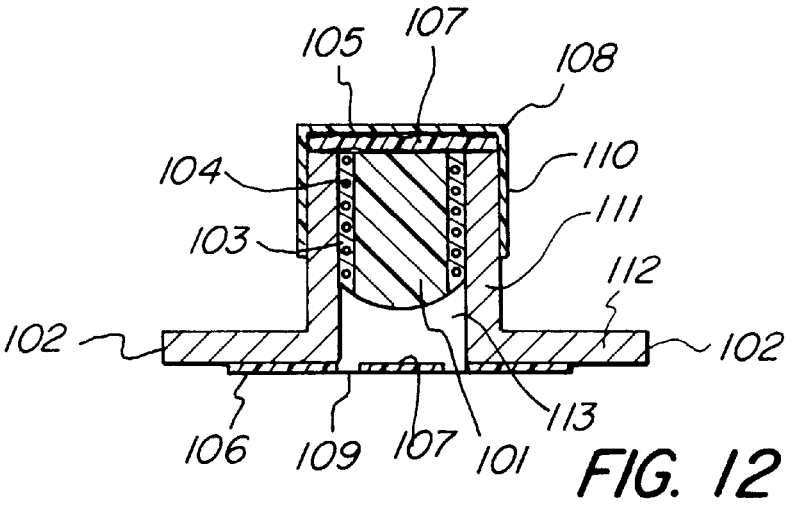
FIG. 12 is a cross-sectional end view of the joint of FIG. 11.

Turning now to FIGS. 11 and 12, another field limitation joint of the invention is there shown. It has a core 101 of closed cell synthetic elastomer and L-section side members 102 of aluminum for instance. The core is adhered to the side members by double sided adhesive strip 103 of the type having reinforcing filaments 104 running along the length of the strip. The foam core can be of EPDM, polychloroprene—for example NEOPRENE from Dupont—or polyethylene.

The core is pre-compressed and held in compression by tapes 105,106. These are fabric reinforced and incorporate a central strip 107 of polymer film rendering them non-adhesive along their centre. Also they have perforations 108,109 along their length at the edge of the strip 107. The adhesive edge 110 of the tape 105 are adhered to the outside of upright limbs 111 of the side members and pass over the top of the side members. Here the non-adhesive strip 107 prevents the tape 105 from adhering to the core 101. The perforations 108 run along the top edge of the side members . The other tape 106 extends between the other limbs 112 of the side members on their undersides, again with the non-adhesive strip preventing adhesion to the core 101 .This is in fact set up from the tape, with a gap 113 existing between the limbs 112.

The adhesive tapes are applied with the core under compression and they maintain this compression.

On installation, for instance to wet screed as in FIG. 2 or onto adhesive to which tiles also are to be set, the tapes maintain the compression of the core. After laying of the finish layer of the floor, for instance the tiles just mentioned, the compression can be released. The top tape 105 is provided with an end tab 114 and the tape is ripped along the perforations 108. The installation is likely to prevent initial movement to cause the perforations 109 in the bottom tape to tear. However, these will tear if the substrate cracks along the line of the joint with expansion of it. Normally the joint will be installed over a crack inducing slot as is conventional for a field limitation joint. To assist operation as intended, the perforations 109 in the bottom tape are more numerous than the perforation 108 in the top tape, and they would rip on ripping of the top tape in the absence of restraint of the joint on installation.

Figure 13:
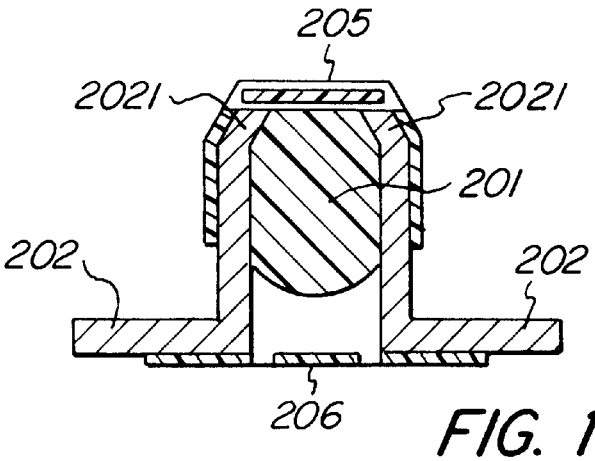
FIG. 13 is a cross-sectional end view of another field limitation joint.

Another field limitation joint is shown in FIG. 13. It has many similarities to the previous joint, particularly in having a core 201, generally L-shaped side members 202, and compression retention tapes 205,206 similar to the equivalent members.

However, this joint is formed as a co-extrusion of plastics materials. For instance, ALCRYN material can be co-extruded for the core in solid, non-rigid form with polyvinylchloride side members. Alternatively, a thermoplastics rubber core of SANTOPRENE material as sold by Monsanto can be co-extruded with polycarbonate side members.

The side members 202 have top sections 2021 which taper slightly inwards, whereby the degree of pre-compression of the core at the top is higher than in its main body below.

Figure 14:
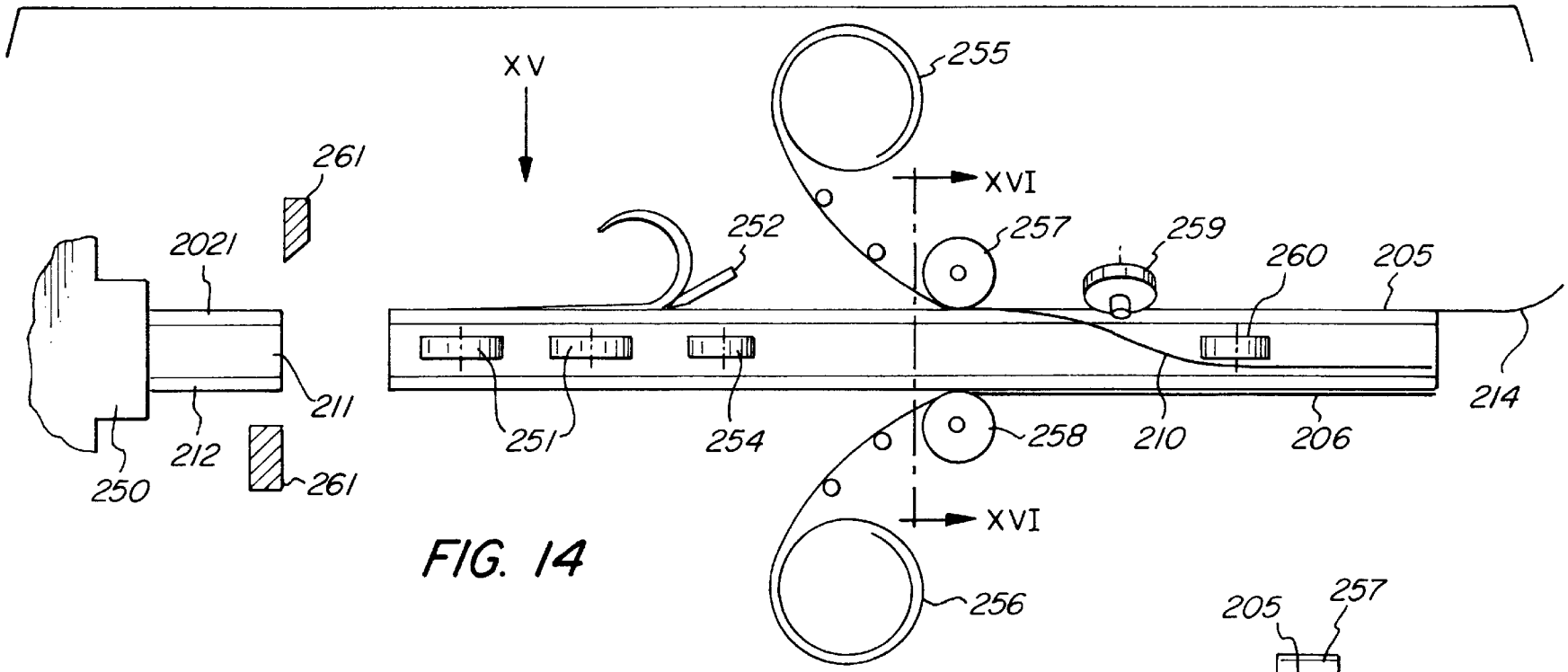
FIG. 14 is a diagrammatic view of apparatus for producing the joint of FIG. 13.
Figure 16:
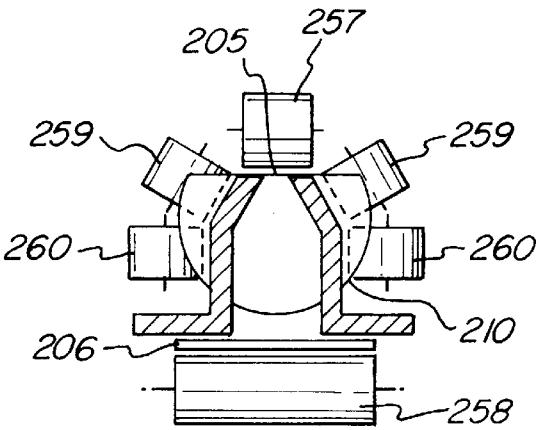
FIG. 16 is a cross-sectional end view on the line XVI—XVI in FIG. 14.
Figure 15:
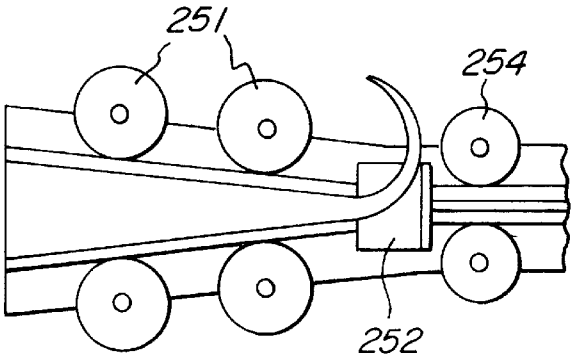
FIG. 15 is a scrap plan view in the direction of arrow XV in FIG. 14.

Turning now to FIGS. 14,15 and 16, production of this joint in accordance with the invention is shown. From a co-extrusion machine 250, the joint is extruded in uncompressed form to a series of nip rollers 251. These progressively compress the joint typically to 50% of the original core size. Any core material pushed up above the side members is trimmed by a knife 252 and the joint is passed on to further rollers 254, which maintain the compression. The tapes. 205,206 are fed to the joint from rolls 255,256 thereof, Guide rollers 257 above the joint and 258 below the joint bear on the tapes to maintain it in alignment. The under roller 258 causes the tape 206 to adhere to the underside of the other limbs 212 of the joint. Downstream of the over roller 257, angled rollers 259 turn the top tape down at the at the top section 2021. Yet further downstream, side rollers 260 press the adhesive edges 210 of the tap onto the outside of the limbs 211 of the joint.

A guillotine 261 between the extrusion machine 250 and the nip rollers 251 severs the joint into convenient length sections. The joints are driven through the rollers by opposite ones of them being powered, conveniently 257 258. On operation of the guillotine, the drive is accelerated beyond the extrusion speed to draw a tab section of the top tape into the synchronism with the guillotined gap.

Figure 17:
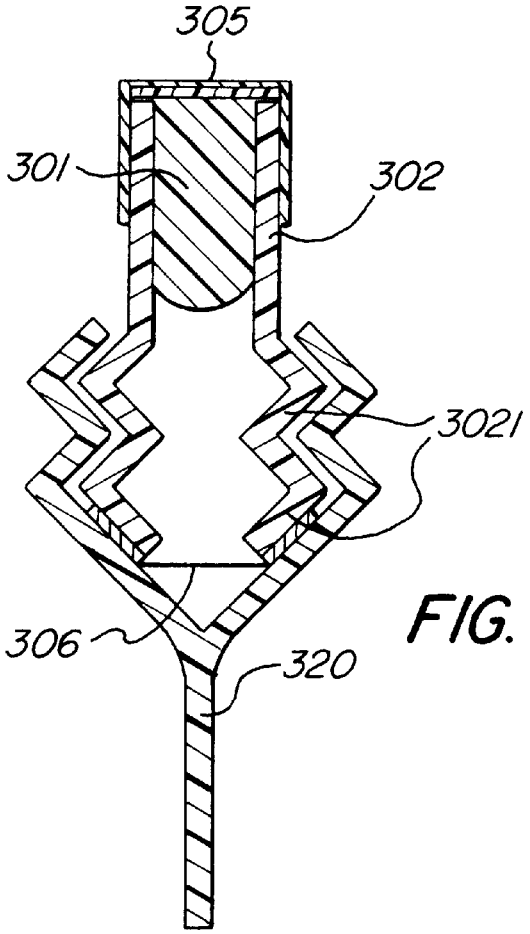
FIG. 17 is a cross-sectional end view of another field limitation joint according to the invention.

The joint shown in FIG. 17 is similar to that shown in FIGS. 5 and 6, except that it is taped to retain pre-compression. The joint has a closed cell elastomeric material core 301 and plastics material side members 302. The core is held in pre-compression by tapes 305,306. The side members give the joint a double arrow head shape 3021 at its bottom edge. This enables a generally Y-shaped extruded extension member 320 to be fitted to the bottom of the joint. The extension enables the joint to create a deeper separation of a semi-dry substrate when pushed into it. Generally the line of the joint will coincide with a design structural dis-continuity in the supporting structure for the substrate.

Figure 18:
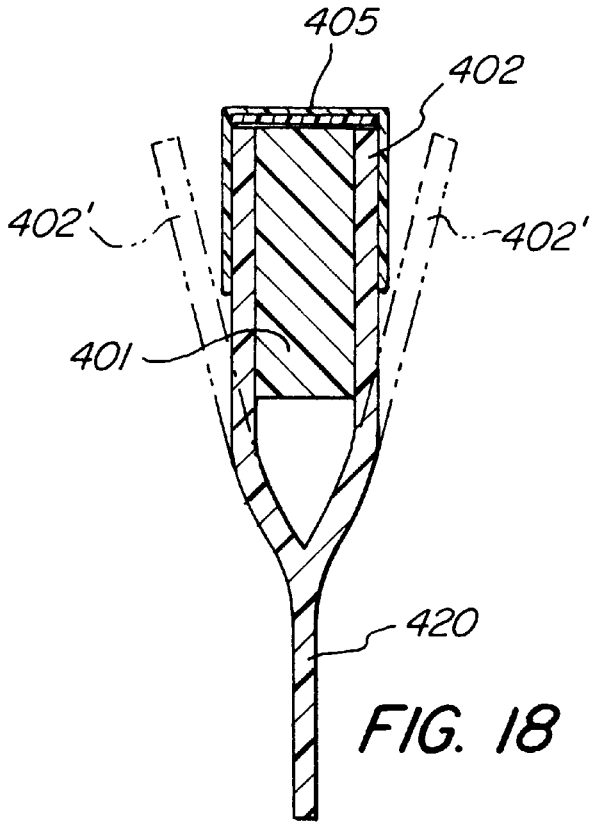
FIG. 18 is similar view of yet another joint of the invention.

As shown in FIG. 18 particularly where an all plastics joint is suitable in place of the metal side member joint of FIG. 17, the extension 420 can be formed integrally with side members 402. The general Y-shape is such that on compression of the core 401, the latter can be held compressed by a top tape 405 only. Compression results in the side members being bent in from their original shape indicated in broken lines 402'. Their resilience contributes to the tendency of the joint to open after ripping of the tape on installation.

The invention is not intended to be restricted to the details of the above described embodiments. Other designs of side members may be used; other pre-compression restraining means provided and other materials used for both the flexible members and the side members. In place of elatomer/metal bonds and co-extrusion bonds, mechanical fixing of the flexible member to the side members may be used, for instance by means of longitudinally assembled dovetail joints.

Aside from having the advantage of allowing a greater degree of movement away from each other before their cores come under tension, in comparison with non-pre-compressed joints, the above described joints have a reduced visible surface profile. The surface profile is the wear surface, when joint is installed. The reduced surface profile reduces the visible impact of the joint and the extent of surface wear due to traffic. Thus the longevity of the joint is extended.

I claim:

1. A movement joint for installation between elements of a building, the joint comprising: an elongate, flexible core member, two discrete, elongate, solid side members of rigid material bonded or otherwise affixed on an inner side of the solid side members to opposite sides of the flexible core member and adapted to abut the building elements on an outer side of the solid side members in use, and restraining means interconnecting the solid side members for restraining the flexible core member to be under compression prior to installation of the joint between the building elements and for releasing the compression after installation, so that the side members are pressed against the building elements upon release of restraint by the restraining means, the restraining means having flanges engaging on the outer sides of the solid side members for gripping the side members to restrain the core member under compression.

2. A movement joint as claimed in claim 1, wherein the restraining means comprises U- or Y-section clips engaging by their limbs outside the side members.

3. A movement joint as claimed in claim 1, wherein the restraining means is at least one tape adhered to the side members.

4. A movement joint as claimed in claim 3, wherein the tape is fibre reinforced tape.

5. A movement joint as claimed in claim 3, wherein the tape is perforated for tearing, preferably at edges of the side members, for release of the compression in the core member.

6. A movement joint as claimed in claim 3, wherein the tape has a central, non-adhesive band for avoiding adhesion to the core member.

7. A movement joint as claimed in claim 3, wherein one tape is provided at a top of the joint and another tape is provided at the bottom of the joint.

8. A movement joint as claimed in claim 1, wherein the side members each have an upright limb and a horizontal limb and are L-shaped, the upright limbs having the flexible core member between them and the horizontal limbs extending away from each other and being adapted for fixture of the joint.

9. A movement joint as claimed in claim 1, wherein the joint has a pointed cross-section, the side members converging towards each other at the bottom of the joint.

10. A movement joint as claimed in claim 9, wherein the side members are integrally connected to each other at the bottom of the joint.

11. A movement joint as claimed in claim 9, including an extension beyond the bottom edge of the side members.

12. A movement joint as claimed in claim 11, wherein the extension is a single wall member integrally connected to the two side members.

13. A movement joint as claimed in claim 11, wherein the extension is a U-section or Y-section engaged by its members outside the side members.

14. A movement joint as claimed in claim 13, wherein the extension and the side members are complementarily shaped for gripping of the side members by the extension.

15. A movement joint as claimed in claim 13, wherein the extension is adapted to contribute to compression retention of the flexible core member.

16. A movement joint as claimed in claim 1, wherein the side members locally taper inwardly toward each other at their top.

17. A movement joint as claimed in claim 1, wherein the flexible core member is bonded to the side members by adhesive.

18. A movement joint as claimed in claim 17, wherein the adhesive is double sided tape adhesive with longitudinal reinforcement.

19. A movement joint as claimed in claim 17, wherein the side members are of metal or plastics material and the flexible core member is of synthetic elastomeric material, preferably closed cell foam material.

20. A movement joint as claimed in claim 1, wherein the side members and flexible core member are co-extrusions of plastics material side plates and synthetic elastomeric material core member, the latter preferably being of closed cell foam material.

21. A movement joint as claimed in claim 19, wherein the flexible core member has a Shore hardness in the range 25° to 60°, preferably 30° to 45°.

22. A method of producing a movement joint as claimed in claim 19, the method comprising the steps of:

applying the adhesive longitudinally to the flexible core member or the insides of the side members;

bonding the side members to the flexible core member;

compressing the flexible core member;

applying the restraining means to the joint to retain the flexible core member under compression prior to installation.

23. A method of producing a movement joint as claimed in claim 20, the method comprising the steps of:

co-extruding the side plates of plastics material and the flexible core member of synthetic elastomeric material;

compressing the flexible core member;

applying the restraining means to the joint to retain the flexible core member under compression prior to installation.

24. A method as claimed in claim 22, wherein the restraining means is at least one tape adhered to the side members, the method including the step of:

passing the bonded side members and the flexible core member between at least one pair of rollers for compressing the flexible core member.

25. A method as claimed in claim 24, wherein the flexible core member and the side members are flush at their top after bonding or co-extrusion, the method including the step of:

trimming flexible core member material protruding above the side members preliminarily to applying the restraining tape(s).

26. A method as claimed in claim 24, wherein the flexible core member has a Shore hardness in the range of 25° to 60°, preferably 30° to 45° and where the flexible core member is compressed by between 40% and 60%, preferably between 45% and 55%.

* * * * *

UNITED STATES PATENT AND TRADEMARK OFFICE

CERTIFICATE OF CORRECTION

PATENT NO. : 5,904,439

DATED : May 18, 1999

INVENTOR(S) : Seamus M. Devlin

It is certified that error appears in the above-identified patent and that said Letters Patent is hereby corrected as shown below:

In column 1, line 13, "substrata" should be --substrate--.
In column 1, line 20, "Into" should be --into--.
In column 1, line 51, After "tape", "," should be deleted.
In column 2, line 2, after "Equally", --,-- should be inserted.
In column 2, line 9, after "materials", "," should be --.--.
In column 2, line 40, after "width of", "a" should be deleted.
In column 3, line 9, "plastic" should be --plastics--.
In column 3, line 19, "cores" should be --core--.
In column 3, line 32, before "wet", "a" should be deleted.
In column 4, line 12, after "members", "," should be --.--.
In column 5, line 30, "Spelling" should be --Spalling--.
In column 5, line 49, "edge" should be --edges--.
In column 6, line 33, after "tapes", "," should be deleted.
In column 6, line 34, after "thereof", "," should be --.--.
In column 6, line 45, "257258" should be --257, 258--.
In column 6, line 61, after "Fig. 18", please insert --,--.
In column 7, line 6, "used;" should be --used,--.

Signed and Sealed this

Fourth Day of July, 2000

*Attest:*

*Attesting Officer*

Q. TODD DICKINSON

*Director of Patents and Trademarks*